United States Patent [19]

Hudson et al.

[11] 4,215,607

[45] Aug. 5, 1980

[54] APPARATUS FOR HEAT CUTTING SHEET MATERIAL

[75] Inventors: Wilber G. Hudson; Ronald B. Welch, both of Columbus, Ga.

[73] Assignee: Lummus Industries, Inc., Columbus, Ga.

[21] Appl. No.: 908,398

[22] Filed: May 22, 1978

[51] Int. Cl.[2] ..... B26D 7/10

[52] U.S. Cl. ..... 83/111; 83/16; 83/171; 83/698; 156/575; 219/243

[58] Field of Search ..... 83/15, 16, 18, 118, 83/111, 171, 698; 219/243; 30/140; 156/575

[56] References Cited

U.S. PATENT DOCUMENTS

| | | | |
|---|---|---|---|
| 1,802,968 | 4/1931 | Everett et al. | 83/171 |
| 2,244,550 | 6/1941 | Chandler | 83/16 X |
| 2,484,619 | 10/1949 | George | 83/171 |
| 2,623,586 | 12/1952 | Volpi | 83/171 |
| 3,912,575 | 10/1975 | Zelnick | 156/515 |
| 3,922,958 | 12/1975 | Bate | 156/515 |

FOREIGN PATENT DOCUMENTS

| | | | |
|---|---|---|---|
| 291466 | 10/1966 | U.S.S.R. | 83/171 |

*Primary Examiner*—W. Donald Bray
*Attorney, Agent, or Firm*—Jennings, Carter & Thompson

[57] ABSTRACT

The application discloses an assembly comprising an elongated knife in association with a heating unit together with means to mount the assembly so as substantially to eliminate all warping or other distortion of the knife due to heat. Specifically, the knife is mounted directly against the sheath of an electric resistance type heating unit. The heating unit and knife are mounted from a supporting frame in such fashion that they may expand or "grow" axially, thus substantially to eliminate distortion of the heating unit and knife. Also associated with the supporting framework for the heating unit and knife is means slightly to tension the sheet to be cut on either side of the knife, while the cutting takes place, thus to prevent after-cutting contact of the sheet edges with the knife.

6 Claims, 8 Drawing Figures

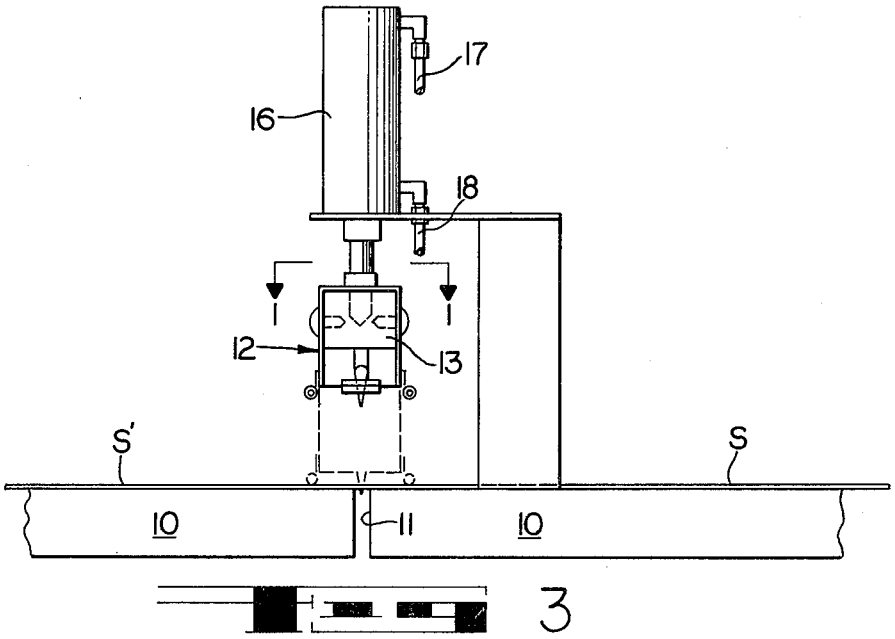
17
16
18
1
1
12
13
S'
S
10
11
10
3
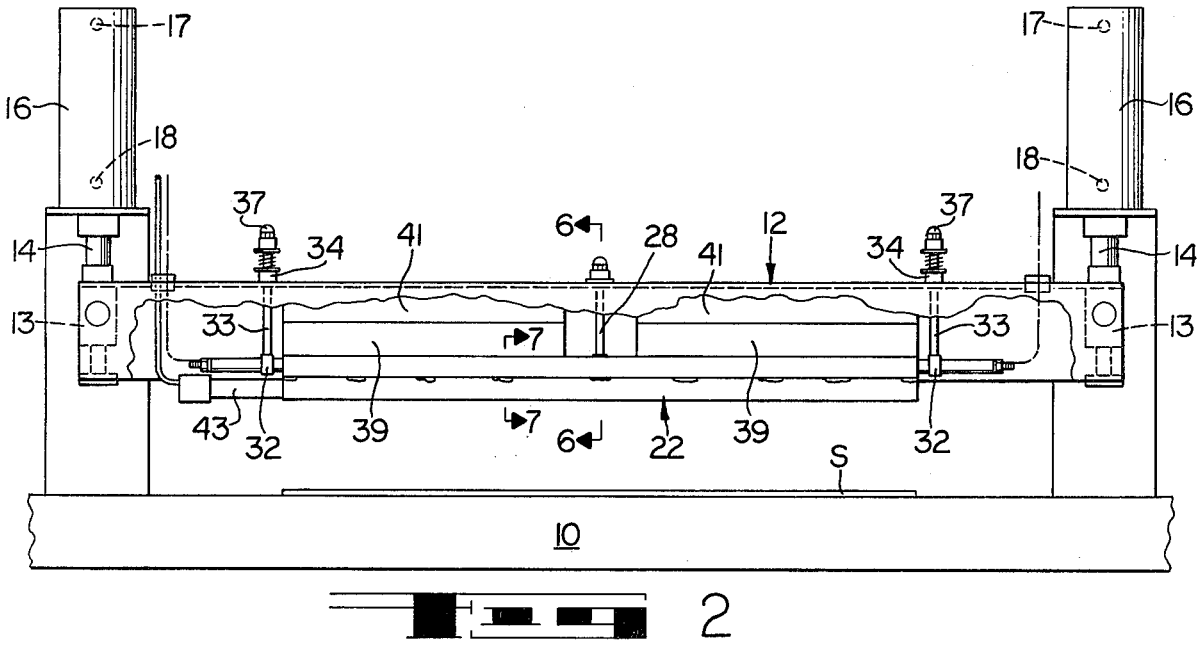
17
17
16
16
18
18
37
37
14
34
41
6
28
12
41
34
14
13
33
7
33
13
43
32
39
7
6
22
39
32
S
10
2
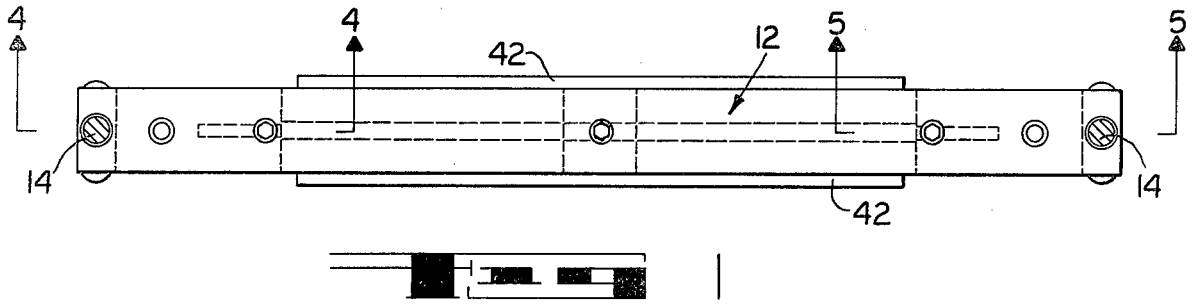
4
4
42
12
5
5
14
14
42
1

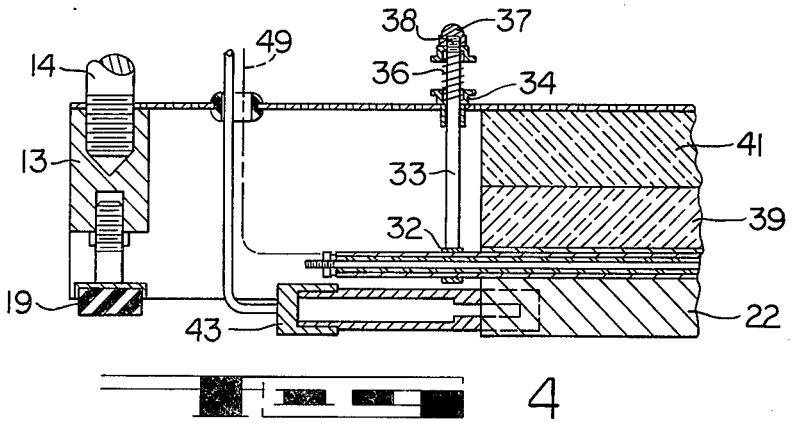
4
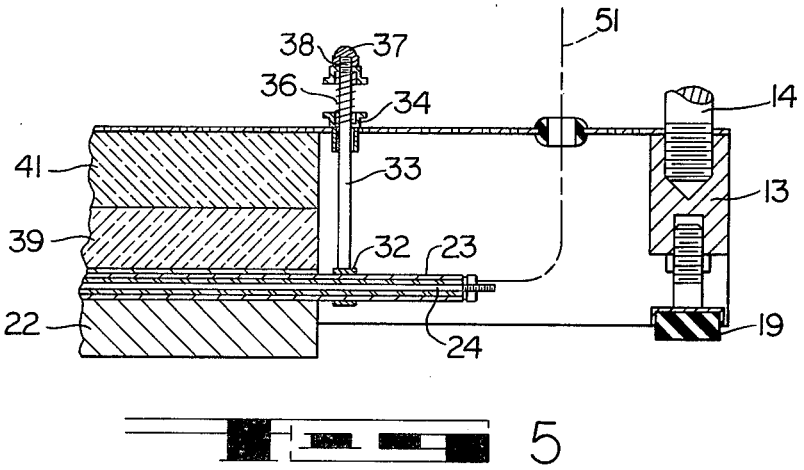
5
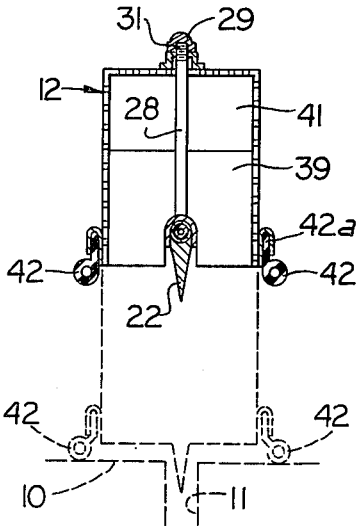
6

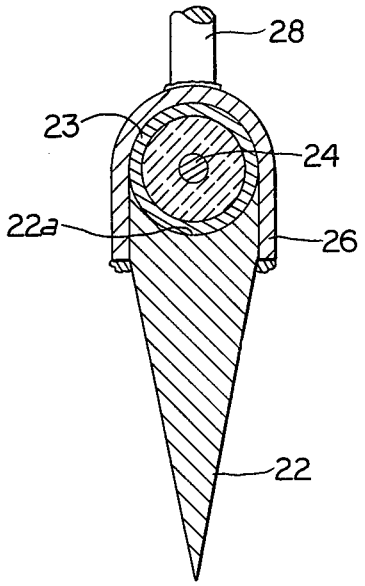
7
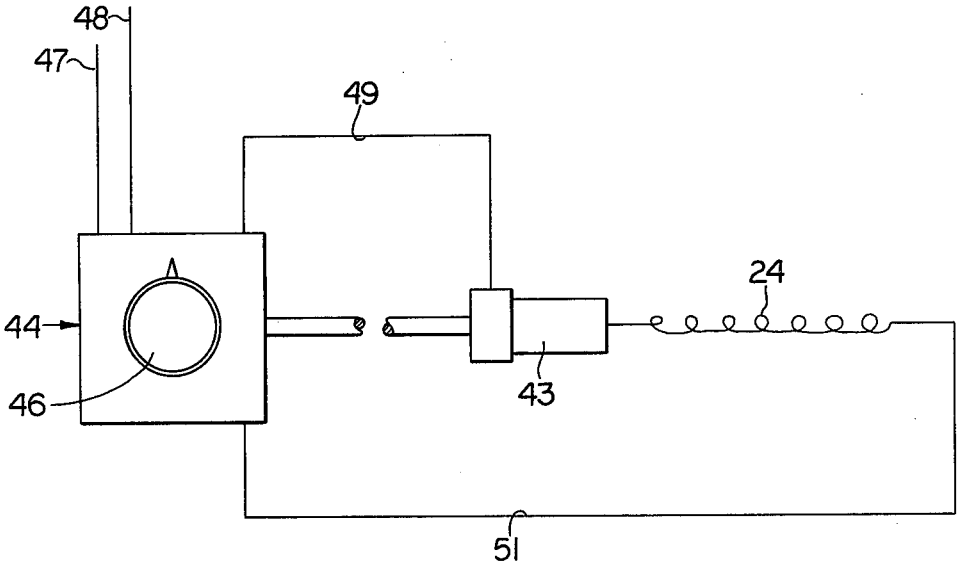
8

APPARATUS FOR HEAT CUTTING SHEET MATERIAL

This invention relates to a hot knife for cutting sheet material and has for its object the provision of such a unit which, by and large, eliminates the distortion, warping, and uneven cutting heretofore associated with such elongated cutting knives or units.

In the art to which our invention relates it has long been known to "cut" sheet materials such as the so-called "plastic" materials by means of an elongated, sharp, heated knife-like unit. When these knives are heated and the sharp edge thereof is brought into contact with the sheet of plastic material, the sheet is "cut" by what amounts to a melting process along the line of contact. However, one difficulty with prior apparatus of this type has been that the knives were mounted so that when heated considerable distortion by way of warping, bending, etc. takes place. Such distortion in prior apparatus resulted in uneven cutting, or no cutting at all, across certain portions of the sheet. Further, due to the construction of prior apparatus the same could not be used for rapid, continuous cutting of sheets because of the bleed-off of heat from the unit to its mounting, thereby requiring a considerable time interval between operations in order to permit the knife to come back up to the proper temperature.

In view of the foregoing a prime object of our invention is to overcome the difficulties set out above and to provide an economical, highly efficient, light-weight and compact unit which may be easily and simply mounted for vertical reciprocation so as to "cut" a sheet of plastic material placed beneath the same.

Specifically, our invention contemplates a melting or cutting unit which is positioned in direct contact with the metal outer sheath of an electric resistance unit, together with means to suspend the assembly in such fashion that the same may expand axially without appreciable distortion in any plane.

A further object of our invention is to provide means associated with the knife support mechanism to slightly tension the sheet on each side of the knife so that when the sheet is cut the cut edges are moved slightly apart, thus assuring the cutting of a straight edge and positively preventing the cut edges from further contact with the knife.

Apparatus illustrating features of our invention is shown in the accompanying drawings forming a part of this application in which:

FIG. 1 is a plan view taken generally along line 1—1 of FIG. 3;

FIG. 2 is a front elevational view with certain parts broken away;

FIG. 3 is an end elevational view with the cutting mechanism in raised position and showing the same in lowered, "cutting" position in dotted lines;

FIG. 4 is an enlarged detail sectional view taken generally along line 4—4 of FIG. 1;

FIG. 5 is an enlarged detail sectional view taken generally along line 5—5 of FIG. 1;

FIG. 6 is an enlarged detail sectional view taken generally along line 6—6 of FIG. 2;

FIG. 7 is an enlarged detail sectional view taken on line 7—7 of FIG. 2; and,

FIG. 8 is a diagrammatic view illustrating a set of controls for our improved apparatus.

Referring now to the drawings for a better understanding of our invention, at 10 we show a table over which a sheet of material S to be cut into lengths is passed. The table is provided with a notch 11 extending across the same, which notch is open at its bottom.

At 12 we show an inverted U-shape frame in which our improved knife and insulation therefor are mounted. Preferably, the frame 12 is made of perforated, thin sheet metal, such for instance as stainless steel. The frame 12 carries at each end blocks indicated at 13. Secured to the blocks 13 are the piston rods 14 of a pair of double-acting fluid pressure cylinders 16. Fluid under pressure from a suitable source, not shown, may be supplied simultaneously to the cylinders 16 alternately through upper and lower connections 17 and 18 thereto.

Adjustably received in the blocks 13 are stop members 19 which are adapted to adjustably limit the downward movement of the frame and hence the "knife" carried thereby all as will presently appear.

Our improved knife and heating element assembly is mounted in the frame 12 as will now be explained. The knife proper indicated at 22 is elongated and generally triangular in cross section. As best shown in FIG. 6 the knife is concaved as indicated at 22$^a$ to fit snugly against the rounded shape of the metal sheath 23 surrounding an electric resistance heat unit or wire 24. The knife preferably is made of stainless steel and is contoured to the circular shape of the sheath of the heat unit so that there is intimate, close and firm contact between the sheath and the knife throughout the length of the knife. In order to assure that the knife and heat unit are held in close, intimate contact, we wrap a thin sheet of metal indicated at 26 over the top of the heat unit and partially down the sides of the knife and weld this sheet to the knife at intervals along the length thereof. Due to this construction, the metal sheath of the heat unit and the knife are free to expand axially independently of each other while the sheet 26 affords a good support for the knife. We have found that placing the sheet 26 about the heating unit on the side opposite the knife provides a heat sink which evens out the temperature in the unit, prolonging its life.

An important feature of our invention is the method of suspending the knife and heating assembly in the frame. Thus, at the center of the unit we weld to the sheet 26 a stud or rod-like support member 28. The rod-like member 28 passes through the top of the frame member 12 and may be secured by a nut 29 on a threaded section 31 of the rod.

Adjacent the ends of the heat unit we provide sleeves 32 which loosely surround the heating unit. Secured to the sleeves are other support members 33 and these pass loosely through ferules 34 secured to the frame member 12. The support members 33 project outwardly of the top of the frame 12. Surrounding the projecting ends of the members 33 are springs 36. The springs are held in place as shown by nuts 37 carried on threaded sections 38 of the members 33.

In order to minimize heat loss from the "knife" and also to prevent heat absorption by the housing or frame, we provide lengths of insulating material 39. These are placed so as partially to surround the knife and heating unit assembly and extend downwardly alongside the knife as shown particularly in FIG. 6.

The insulating blocks or units 39 are spaced from the top of the housing or frame member 12 by other lengths of the same material indicated by 41. While we show these as being continuous, it is possible to use only intermittent lengths of the insulating material 39 and 41.

Mounted along the lower extremities of the frame member 12 are flexible members of rubber-like material 42. These members are so mounted that when the unit is lowered onto the material to be cut the members 42 frictionally engage the material and are spread slightly apart as shown in dotted lines, FIG. 6, thus slightly to stretch the material on the table, over the notch 11. When the knife severs the material the members 42 move the severed edges slightly away from the knife due to the action of the members 42, thus assuring a clean breakaway of the severed edges, further assuring a clean, proper cut.

The above action of members 42 is obtained by forming them of rubber-like material and mounting the edges 42$^a$ thereof as shown. The members 42 are thus resiliently biased away from each other when in contact with the sheet.

Associated with one end of the knife is a thermocouple indicated generally and diagrammatically by the numeral 43. The thermocouple 43 may have its sensing unit associated with a control box indicated at 44. See FIG. 8. The control 44 may have an adjustable temperature set point knob indicated at 46. Energy may be supplied to the system through lines 47 and 48 and from the control box to the unit 24 through lines 49 and 51.

With the foregoing description in mind it is now possible more fully to explain the construction, operation and advantages of our improved apparatus. It will be understood, as stated, that the object is to sever from the sheet S a length S′ thereof. Further, it will be understood that our apparatus is designed to cut wide sheets, namely, those on the order of eighty inches in width, and even wider.

With the apparatus in the full line position as shown in the drawings, the sheet S is fed across the table 10 so that the length S′ to be cut extends past the notch or slot 11. The unit is energized to bring the knife 22 up to temperature, the cylinders 16 are energized, bringing the entire unit down so that the knife contacts the top of the sheet, over the notch 11. As soon as the members 42 contact the top of the sheet they are put under resilient pressure tending to move them apart, thus to stretch the sheet over the notch so that when the knife severs the material the cut edges move slightly away from each other, removing them from the knife and preventing "burning" or melting of the edges. Any ash or "melt" falls through the slot 11 for disposal. The depth of penetration of the knife may be adjusted by the members 19.

It will be seen that our improved suspension means permits the heating unit and the knife carried thereto to expand axially, substantially completely independently of each other and of the supporting means. In other words, by suspending the knife at the center by means of the support member 28 and by loosely suspending the heating unit by means of the sleeves 32 and members 33, the heating unit and knife are unrestrained insofar as the natural tendency to "grow" or expand axially is concerned. At the same time the knife is well insulated and is held accurately enough in the assembly to permit it to move down onto the sheet and to "cut" the sheet along a substantially straight line. Also, our improved mounting means substantially eliminates bleed-off of heat into the supporting framework so that our apparatus may operate continually without having to shut it down for cooling.

In view of the foregoing it will be seen that we have devised an improved hot knife apparatus for "cutting" sheets of plastic material and the like. In actual practice our invention has proved to be satisfactory and we have in fact used it continuously without heat build-up, without appreciable knife deflection in any plane and with high reliability in operation. Our invention is particularly useful in cutting the so-called "woven" plastic sheets, both of the coated and uncoated types. By way of example, we have successfully continuously cut materials such as polypropolyene.

While we have shown our invention in but one form it will be obvious to those skilled in the art that it is not so limited, but is susceptible of various changes and modifications without departing from the spirit thereof.

What we claim is:

1. In apparatus for heat severing sheet material, (a) an elongated knife-like sheet severing member having a sheet contacting edge, (b) means to apply heat to the knife-like member comprising an electric resistance element encased in a metal sheath, said sheath being in intimate contact with an edge of the knife-like member opposite its sheet contacting edge, (c) a frame for the knife-like member mounted for movement toward and from a sheet to be severed, (d) means mounting the knife-like member in the frame with its sheet contacting edge projecting from the frame, (e) said mounting means supporting the knife-like member including a member operatively connected to the knife-like member adjacent its longitudinal midpoint, and (f) means adjacent the ends of the knife-like member operatively connected to and supporting the same from the frame while permitting unrestrained axial expansion of the knife-like member when heated.

2. Apparatus as defined in claim 1 in which there is means carried by the frame and operative while the knife-like member is severing the sheet to urge portions of the sheet material on opposite sides of the knife away from each other, said means comprising a pair of elongated friction members disposed to engage the sheet along the opposite sides of the knife-like member while the latter is severing the sheets, and means to bias said members away from each other while in contact with the sheet and while the knife-like member is severing the sheet, whereby when the sheet is severed the edges move away from the knife-like member, thus to remain out of contact therewith after being severed.

3. for use in heat severing sheet material and the like, an assembly comprising, (a) an elongated metal sheathed electric resistance heating unit, (b) an elongated knife-like member having a material engaging edge and another edge intimately contacting a portion of the sheath of the heating unit, (c) means adjacent the longitudinal center of the assembly for securing the assembly to a supporting member, and (d) means adjacent the ends of the assembly for securing the same to a support while permitting free axial expansion of the assembly from the longitudinal center thereof outwardly in response to heating of the heat unit.

4. An assembly as defined in claim 3 in which there is an elongated sheet of metal extending around the heating unit on the side opposite the knife-like member and having its edges secured at least at intervals therealong to the sides of the knife-like member.

5. For use in heat severing sheet material and the like, an assembly comprising, (a) an electric resistance heating unit having an outer metal sheath generally circular in cross section, (b) an elongated knife-like member having a sheet engaging edge, (c) the edge of the knife-like member opposite the sheet engaging edge being concavely shaped to receive and intimately contact at least a portion of the surface of the metal sheath of the heating unit, (d) a sheet of metal substantially the length of the knife-like member wrapped about the sheath of the heating unit and extending alongside the knife-like member but terminating short of the sharp edge thereof, and (e) means to secure the edges of said sheet to the sides of the knife-like member at least at intervals therealong, whereby the heating unit and knife-like member are free for independent axial expansion when heated.

6. Apparatus as defined in claim 5 in which a support member for the assembly is secured to said sheet adjacent the midpoint of the length of the knife-like member.

* * * * *

UNITED STATES PATENT AND TRADEMARK OFFICE

CERTIFICATE OF CORRECTION

PATENT NO. : 4,215,607

DATED : August 5, 1980

INVENTOR(S) : Wilbur G. Hudson and Ronald B. Welch

It is certified that error appears in the above—identified patent and that said Letters Patent is hereby corrected as shown below:

The spelling of "Wilber" on the patent should be corrected as follows: "Wilbur" so that inventor Hudson's name reads -

- Wilbur G. Hudson -

Signed and Sealed this

*Eleventh* Day of *November 1980*

[SEAL]

*Attest:*

SIDNEY A. DIAMOND

*Attesting Officer*

*Commissioner of Patents and Trademarks*